United States Patent [19]

Oakes

[11] Patent Number: 4,481,129

[45] Date of Patent: Nov. 6, 1984

[54] BLEACH COMPOSITIONS

[75] Inventor: John Oakes, South Wirral, England

[73] Assignee: Lever Brothers Company, New York, N.Y.

[21] Appl. No.: 446,103

[22] Filed: Dec. 2, 1982

[30] Foreign Application Priority Data

Dec. 23, 1981 [GB] United Kingdom ..... 8138829

[51] Int. Cl.[3] ..... C11D 7/54; C11D 3/395; D06L 3/02

[52] U.S. Cl. ..... 252/186.41; 252/95; 252/99

[58] Field of Search ..... 252/186.1, 186.38, 186.41, 252/186.43, 95, 99

[56] References Cited

U.S. PATENT DOCUMENTS

| | | | |
|---|---|---|---|
| 3,034,851 | 5/1962 | Dustman | 252/186.41 X |
| 3,156,654 | 11/1964 | Konecny et al. | 252/186.38 X |
| 3,280,039 | 10/1966 | Smolens | 252/186.43 |
| 3,372,125 | 3/1968 | Hill et al. | 252/99 |
| 3,532,634 | 10/1970 | Woods | 252/186.4 X |
| 4,016,090 | 4/1977 | Nakagawa et al. | 252/186.38 X |
| 4,075,116 | 2/1978 | Mesaros | 252/99 |
| 4,119,557 | 10/1978 | Postlethwaite | 252/186.41 X |
| 4,299,717 | 11/1981 | Cottrell et al. | 252/99 |

FOREIGN PATENT DOCUMENTS

| | | | |
|---|---|---|---|
| 25608 | 3/1981 | European Pat. Off. . | |
| 72166 | 2/1983 | European Pat. Off. | 252/99 |
| 984459 | 2/1965 | United Kingdom | 252/99 |
| 1598610 | 9/1981 | United Kingdom . | |

*Primary Examiner*—Benjamin R. Padgett
*Assistant Examiner*—Virginia B. Caress
*Attorney, Agent, or Firm*—Milton L. Honig; James J. Farrell

[57] ABSTRACT

Bleach compositions comprising a peroxide compound contain manganese (II) in an amount of 0.005 to 5% by weight and a carbonate compound which delivers carbonate ions in aqueous solution in an amount of 1 to 50% by weight of carbonate ions.

The bleach compositions are suitable for bleaching fabrics at substantially all washing temperatures.

10 Claims, No Drawings

BLEACH COMPOSITIONS

This invention relates to bleach compositions comprising a peroxide compound bleach suitable for bleaching fabrics. The peroxide compound bleach used herein include hydrogen peroxide and inorganic persalts which liberate hydrogen peroxide in aqueous solutions such as the water-soluble perborates, percarbonates, perphosphates, persilicates and the like.

Detergent compositions comprising said peroxide compounds are known in the art. Since said peroxide compounds are relatively ineffective at lower temperatures, e.g. up to 70° C., these compositions have to be used at boiling temperatures in order to achieve a satisfactory bleach.

Various proposals have been made to activate peroxide compounds so as to make them usable bleaches at lower temperatures. One proposed route is the use of so-called organic activators—usually organic compounds having one or more reactive acyl residues—which in solution react with the peroxide compound, e.g. sodium perborate, to form an organic peroxy-acid e.g. peroxyacetic acid, which is a more effective bleach at lower temperatures. Such bleach activators are described for example in a series of articles by Allan H. Gilbert in "Detergent Age", June 1967, pages 18–20, July 1967, August 1967, pages 26, 27 and 67.

Another approach is the use of heavy metal ions of the transition series which catalyse peroxide decomposition, together with a special type of chelating agent for said heavy metal as described in U.S. Pat. No. 3,156,654.

It is disclosed there that only by a proper choice of the heavy metal and of the chelating agent, not only with respect to each other but also in regard of the adsorption power of the material to be bleached i.e. fabrics, relative to the complexing strength of the chelating agent an improved bleaching can be obtained. Though the possible use of any heavy metal of the transition series, is disclosed, provided the proper chelating agent is employed therewith, only combinations of cobalt and copper salts with pyridine carboxylic acid chelating agents, preferably as a preformed complex, in bleaching baths comprising sodium perborate are disclosed.

U.S. Pat. No. 3,532,634 discloses bleaching compositions comprising a persalt, an organic activator and a transition metal, together with specially selected chelating agents. The transition metals applicable according to this U.S. patent have atomic numbers of from 24 to 29.

British Pat. No. 984,459 suggested the use of a copper salt in combination with a sequestering agent which is methylaminodiacetic acid, aminotriacetic acid or hydroxyethylaminodiacetic acid.

U.S. Pat. No. 4,119,557 suggested the use of a preformed ferric ion complex with a polycarboxyamine type chelating agent.

Still the main problem with heavy metal catalysis is that the results are often inconsistent and/or unsatisfactory in the case of use for washing at lower temperatures.

The present invention seeks to overcome the above problems.

It has now been found that one heavy metal in particular, i.e. manganese, has surprisingly outstanding properties with respect to consistently improving the bleach performance of peroxide compounds at substantially all temperatures, when used in combination with a carbonate compound which delivers carbonate ions ($CO_3^{2-}$) in aqueous media, which effect has been observed in the absence of any special type of chelating agents as proposed in U.S. Pat. Nos. 3,156,654 and 3,532,634.

The manganese used in the present invention can be derived from any manganese (II) salt, such as manganous sulphate and manganous chloride, or from any manganese compound which delivers manganese (II) ions in aqueous solution.

The effect increases with increased manganese (II) ion concentration in the wash solution up to a certain level, whereupon the effect begins to slow down. On the other hand the carbonate effect increases continuously with the carbonate level, the upper level of which is only limited by other practical limitations, such as formulation requirements.

The optimum levels of manganese (II) ions—$Mn^{2+}$—in the wash/bleach solution are dependent upon the formulation in which the manganese as bleach catalyst is applied, especially upon detergency builder type and level. In terms of parts per million (ppm) of manganese (II) ions in the wash/bleach solution a suitable range will generally be from 0.1 to 50 ppm, preferably from 0.5–25 ppm.

These correspond roughly to a manganese (II) metal content in a bleach or detergent composition of about 0.005–5% by weight, preferably from 0.025–2.5% by weight of the composition.

It was further discovered that alkalimetal triphosphate, particularly sodium triphosphate, has a negative influence on the catalysing effect. Hence the higher levels within said above range are usable in compositions containing alkalimetal triphosphate as the main builder constituent, whereas if the bleach system is free from triphosphate builder, the effective level of $Mn^{2+}$ in the wash/bleach solution will be in the range of about 0.1–10 ppm, preferably 0.5–8 ppm which range corresponds to a manganese (II) content in the composition of about 0.005–1% by weight, preferably 0.025–0.8% by weight.

The carbonate effect on the catalytic activity of manganese can be observed already with carbonate ion levels in the wash/bleach solutions of about 150 ppm. This corresponds roughly with a carbonate ion content in the compositions of about 1% by weight. The effects increase consistently with increasing levels of carbonate, 50% by weight of carbonate ion being taken as the practical upper level in the compositions. In fact the effects are so marked that large activation can be achieved with carbonate-built detergent compositions comprising sodium perborate. A preferred range of carbonate ion level is from about 5–35% by weight.

Accordingly the invention provides a bleach composition comprising a peroxide compound which is characterized in that it comprises manganese (II) in an amount of 0.005–5% by weight, preferably 0.025–2.5% by weight, and a carbonate compound which delivers carbonate ions in aqueous media, in an amount of 1–50 wt.%, preferably 5–35 wt.%, expressed as carbonate ion level in the composition.

Any manganese (II) salt can in principle be employed, such as for example manganous sulphate ($MnSO_4$), either in its anhydrous form or as hydrated salt, manganous chloride ($MgCl_2$) anhydrous or hydrated and the like. Any carbonate compound which delivers carbonate ions in aqueous media can in principle be employed, including alkalimetal carbonates and percarbonates, such as for example sodium carbonate ($Na_2CO_3$), potassium carbonate ($K_2CO_3$), sodium percarbonate ($Na_2CO_3 \cdot 1.5H_2O_2$), and potassium percarbonate ($K_2CO_3 \cdot 1.5H_2O_2$). At least 1% by weight preferably from 5% by weight, calculated as carbonate ion, of any of these salts or mixtures thereof are contemplated in the practice of this invention.

The bleach composition of the invention may also contain a surface active agent, generally in an amount of from about 2% to 50% by weight, preferably from 5–30% by weight. The surface active agent can be anionic, nonionic, zwitterionic or cationic in nature or mixtures thereof.

Preferred anionic non-soap surfactants are water-soluble salts of alkyl benzene sulphonate, alkyl sulphate, alkyl polyethoxy ether sulphate, paraffin sulphonate, alphaolefin sulphonate, alpha-sulfocarboxylates and their esters, alkyl glyceryl ether sulphonate, fatty acid monoglyceride sulphates and sulphonates, alkyl phenol polyethoxy ether sulphate, 2-acyloxy-alkane-1-sulphonate, and beta-alkyloxy alkane sulphonate. Soaps are also preferred anionic surfactants.

Especially preferred are alkyl benzene sulphonates with about 9 to about 15 carbon atoms in a linear or branched alkyl chain, more especially about 11 to about 13 carbon atoms; alkyl sulphates with about 8 to about 22 carbon atoms in the alkyl chain, more especially from about 12 to about 18 carbon atoms; alkyl polyethoxy ether sulphates with about 10 to about 18 carbon atoms in the alkyl chain and an average of about 1 to about 12 —$CH_2CH_2O$-groups per molecule, especially about 10 to about 16 carbon atoms in the alkyl chain and an average of about 1 to about 6 $CH_2CH_2O$-groups per molecule; linear paraffin sulphonates with about 8 to about 24 carbon atoms, more especially from about 14 to about 18 atoms; and alpha-olefin sulphonates with about 10 to about 24 carbons atoms, more especially about 14 to about 16 carbon atoms; and soaps having from 8 to 24, especially 12 to 18 carbon atoms.

Water-solubility can be achieved by using alkali metal, ammonium, or alkanolamine cations; sodium is preferred. Magnesium and calcium cations may be preferred under circumstances described by Belgian Pat. No. 843,636. Mixtures of anionic/nonionic surfactants are contemplated by this invention; a satisfactory mixture contains alkyl benzene sulphonate having 11 to 13 carbon atoms in the alkyl group and alkyl polyethoxy alcohol sulphate having 10 to 16 carbon atoms in the alkyl group and an average degree of ethoxylation of 1 to 6.

Preferred nonionic surfactants are water-soluble compounds produced by the condensation of ethylene oxide with a hydrophobic compound such as an alcohol, alkyl phenol, polypropoxy glycol, or polypropoxy ethylene diamine.

Especially preferred polyethoxy alcohols are the condensation product of 1 to 30 moles of ethylene oxide with 1 mol of branched or straight chain, primary or secondary aliphatic alcohol having from about 8 to about 22 carbon atom; more especially 1 to 6 moles of ethylene oxide condensed with 1 mol of straight or branched chain, primary or secondary aliphatic alcohol having from about 10 to about 16 carbon atoms; certain species of poly-ethoxy alcohol are commercially available under the trade-names of "Neodol" ®, "Synperonic" ® and "Tergitol" ®.

Preferred zwitterionic surfactants are water-soluble derivatives of aliphatic quaternary ammonium, phosphonium and sulphonium cationic compounds in which the aliphatic moieties can be straight or branched, and wherein one of the aliphatic substituents contains from about 8 to 18 carbon atoms and one contains an anionic water-solubilizing group, especially alkyl-dimethyl-propane-sulphonates and alkyl-dimethyl-ammonio-hydroxy- propane-sulphonates wherein the alkyl group in both types contains from about 1 to 18 carbon atoms.

Preferred cationic surface active agents include the quaternary ammonium compounds having one or two hydrophobic groups with 8–20 carbon atoms, e.g. cetyl trimethyl ammonium bromide or chloride, dioctadecyl dimethyl ammonium chloride; and the fatty alkyl amines.

A typical listing of the classes and species of surfactants useful in this invention appear in the books "Surface Active Agents", Vol. I, by Schwartz & Perry (Interscience 1949) and "Surface Active Agents", Vol. II by Schwarz, Perry and Berch (Interscience 1958), the disclosures of which are incorporated herein by reference. The listing, and the foregoing recitation of specific surfactant compounds and mixtures which can be used in the specific surfactant compounds and mixtures which can be used in the instant compositions, are representative but are not intended to be limiting.

In addition thereto the compositions of the invention may contain any of the conventional components and/or adjuncts usable in fabric washing compositions.

As such can be named, for instance, conventional alkaline detergency builders, inorganic or organic, which can be used at levels up to about 80% by weight of the composition, preferably from 10% to 50% by weight.

Examples of suitable inorganic alkaline detergency builders are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g. sodium and potassium ethylenediaminetetraacetates, nitrilotriacetates and N-(2-hydroxyethyl)-nitrilodiacetates; (2) water-soluble salts of phytic acid, e.g. sodim and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid, hydroxymethanediphosphonic acid, carboxyldiphosphonic acid, ethane-1-hydroxy-1,1,2-triphosphonic acid, ethane-2-hydroxy-1,1,2-triphosphonic acid, propate-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No. 3,308,067.

In addition, polycarboxylate builders can be used satisfactorily, including water-soluble salts of mellitic acid, citric acid, and carboxymethyloxysuccinic acid and salts of polymers of itaconic acid and maleic acid. Certain zeolites or aluminosilicates can also be used.

One such aluminosilicate which is useful in the compositions of the invention is an amorphous water-insoluble hydrated compound of the formula $Na_x(_yAlO_2.SiO_2)$, wherein x is a number from 1.0 to 1.2 and y is 1, said amorphous material being further characterized by a $Mg^{++}$ exchange capacity of from about 50 mg eq. $CaCO_3$/g. to about 150 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium ion exchange rate on an anhydrous basis of at least about 2 grains/gallon/minute/gram. These synthetic aluminosilicates are more fully described in British Pat. No. 1,429,143.

If a carbonate builder is used said carbonate will combine builder capacity with the presently found carbonate effect on bleaching.

If other builder substances are used, the required carbonate ion level should be supplied by e.g. using surplus carbonate builder or replacing part of the builder by sodium carbonate or by using wholly or partly sodium percarbonate as the peroxide compound bleach.

For nominally unbuilt compositions, it is contemplated that compositions can contain minor amounts, i.e. up to about 10%, of compounds that, while commonly classified as detergent builders, are used primarily for purposes other than reducing free hardness ions; for example eletrolytes used to buffer pH, add ionic strength, control viscosity, prevent gelling, etc.

Other components/adjuncts commonly used in detergent compositions are for example soil suspending agents such as water-soluble salts of carboxymethylcellulose, carboxyhydroxymethylcellulose, copolymers of maleic anhydride and vinyl ethers, and polyethylene glycols having a molecular weight of about 400 to 10.000. These can be used at levels of about 0.5% to about 10% by weight. Dyes, pigments, optical brighteners, perfumes, enzymes, anti-caking agents, suds control agents and fillers can also be added in varying amounts as desired.

One major advantage of the present invention is that effective bleach improvement at substantially all temperatures is independent of specially selected chelating agents.

A futher advantage is that the present metal catalysed bleaching becomes more efficient at low temperatures when sodium triphosphate bases are replaced by alternative low phosphate to non-phosphate builder systems for both perborate and percarbonate products.

Furthermore the manganese (II)/carbonate system is an effective all-temperature catalyst for peroxide compounds, showing minimal wasteful solution decomposition.

The invention will now be illustrated by the following Examples.

EXAMPLE I

The following compositions were prepared:

| Composition (% by weight) | I | A |
|---|---|---|
| Sodium $C_{12}$ alkyl benzene sulphonate | 12.1 | 12.1 |
| Nonionic ethoxylate | 1.8 | 1.8 |
| Sodium carbonate | 28.5 | — |
| Sodium triphosphate | — | 28.5 |
| Sodium silicate | 5.2 | 5.2 |
| Ethylene diamine tetraacetate | 0.08 | 0.08 |
| Sodium sulphate | 15.0 | 15.0 |
| Sodium perborate tetrahydrate | 23.0 | 23.0 |
| Manganous sulphate | + | + |
| Water up to 100% | | |

These compositions were tested at a dosage of 5 g/l in a 30 minute isothermal wash at 40° C. in 24° H water using varying amounts of $Mn^{2+}$.

The bleaching effects obtained on tea-stained test cloths measured as ΔR (reflectance) were as follows:

TABLE I

| [$Mn^{2+}$] ppm in solution | [$Mn^{2+}$] % in Product | ΔR | ΔR* |
|---|---|---|---|
| 0.5 | 0.01 | 15.0 | 3.0 |
| 1.0 | 0.02 | 17.5 | 3.0 |
| 2.0 | 0.04 | 18.5 | 3.0 |
| 5.0 | 0.10 | 18.5 | 3.0 |
| 8.0 | 0.16 | 15.0 | 3.0 |

*Reflectance of product A without carbonate for comparison.

EXAMPLE II

The following composition was prepared:

| Composition (% by weight) | II |
|---|---|
| Sodium $C_{12}$ alkyl benzene sulphonate | 12.1 |
| Nonionic ethoxylate compound | 1.8 |
| Sodium carbonate | 28.5 |
| Sodium silicate | 5.2 |
| Sodium sulphate | 15.0 |
| Ethylene diamine tetraacetate | 0.08 |
| Sodium percarbonate | 23.0 |
| Manganous sulphate | + |
| Water up to 100%, | |

This composition was tested at a dosage of 5 g/l in a 30 minute isothermal wash at 40° C. in 24° H water, using varying amounts of $Mn^{2+}$.

The bleaching results obtained on tea-stained test cloths measured as ΔR were as follows:

TABLE 2

| [$Mn^{2+}$] ppm in solution | [$Mn^{2+}$] % in Product | ΔR | ΔR* |
|---|---|---|---|
| 0.25 | 0.005 | 15.0 | 3.0 |
| 1.0 | 0.02 | 21.0 | 3.0 |
| 2.0 | 0.04 | 21.0 | 3.0 |
| 5.0 | 0.10 | 20.0 | 3.0 |
| 8.0 | 0.16 | 14.0 | 3.0 |

*Reflectance of Composition A without carbonate for comparison.

EXAMPLE III

Typical bleaching data obtained when sodium triphosphate (STP) in a base composition was successively replaced by carbonate as a builder in a sodium perborate/$Mn^{2+}$ bleach system, keeping the builder and other components levels constant are shown in the table 3 below:

| The base composition used was: | % by weight |
|---|---|
| Sodium $C_{12}$ alkyl benzene sulphonate | 14.0 |
| Sodium triphosphate/carbonate | 30.0 |
| Sodium silicate | 8.0 |
| Sodium sulphate | 13.0 |
| Sodium carboxymethylcellulose | 1.0 |
| Ethylene diamine tetraacetate | 0.13 |
| Fluorescer | 0.5 |
| Sodium perborate tetrahydrate | 23.0 |
| Water up to 100%. | |

Manganous sulphate added to a [$Mn^{2+}$] in solution of 2 ppm.

TABLE 3

Bleaching results on tea-stained test cloths in 40° C. isothermal wash.

| STP/carbonate ratio | ΔR (Reflectance) |
|---|---|
| 100/0 | 2.0 |
| 87.5/12.5 | 3.0 |
| 75/25 | 4.0 |
| 60/40 | 5.5 |
| 50/50 | 6.5 |
| 40/60 | 8.5 |
| 25/75 | 11.0 |
| 0/100 | 16.0 |

EXAMPLE IV

A bleach composition consisting of 99.9% sodium percarbonate and 0.1% $MnSO_4.4H_2O$ was prepared.

Bleaching results on tea-stained test cloths in 40° C. isothermal wash for 20 minutes (dosage adjusted to 0.5 ppm $Mn^{2+}$):

In the absence of $Mn^{2+}$: R=8.7

In the presence of $Mn^{2+}$: R=19.2.

The effectiveness of a carbonate/$Mn^{2+}$ bleach system according to the invention is again clearly shown.

EXAMPLE V

The following compositions were prepared:

| Composition (% by weight) | V | B |
|---|---|---|
| Sodium $C_{12}$ alkyl benzene sulphonate | 12.1 | 12.1 |
| Nonionic ethyoxylate compound | 1.8 | 1.8 |
| Sodium triphosphate | 28.5 | 28.5 |
| Sodium silicate | 5.2 | 5.2 |
| Sodium sulphate | 15.0 | 15.0 |
| Ethylene diamine tetraacetate | 0.08 | 0.08 |
| Sodium percarbonate | 23.0 | 23.0 |
| Manganous sulphate | + | – |
| Water up to 100%. | | |

Composition V was tested on tea-stained test cloths against composition B in a 60 minutes heat-up-to-boil wash using 24° H water. The composition V contained 0.2% by weight of $Mn^{2+}$ and was used at a 5 g/l dosage giving [$Mn^{2+}$] in solution of 10 ppm. Composition B did not contain $Mn^{2+}$ and was used at the same dosage of 5 g/l.

The following bleach results were obtained.

TABLE 4

| Time (min.) | Temp. (°C.) | ΔR (V) | ΔR (B) |
|---|---|---|---|
| 10 | 30 | 0 | 0 |

TABLE 4-continued

| Time (min.) | Temp. (°C.) | ΔR (V) | ΔR (B) |
|---|---|---|---|
| 16 | 40 | 3.5 | 0.5 |
| 25 | 50 | 10.0 | 3.0 |
| 31 | 60 | 15.5 | 8.5 |
| 40 | 70 | 20.0 | 14.5 |
| 46 | 80 | 25.5 | 20.0 |
| 55 | 90 | 31.0 | 27.0 |
| 60 | 95 | 34.0 | 31.0 |

EXAMPLES VI–X

Some typical fabric washing compositions within the invention are further illustrated below.

| Composition (% by weight) | VI | VII | VIII | IX | X |
|---|---|---|---|---|---|
| Sodium $C_{12}$ alkyl benzene sulphonate | 6.0 | 6.0 | 6.0 | 6.0 | 6.0 |
| Nonionic ethoxylate compound | 2.0 | 2.0 | 2.0 | 2.0 | 2.0 |
| Sodium soap | 3.0 | 3.0 | 3.0 | 3.0 | 3.0 |
| Sodium triphosphate | 15.0 | 30.0 | – | 5.0 | – |
| Sodium silicate | 8.0 | 8.0 | 8.0 | 8.0 | 8.0 |
| Sodium carboxymethyl cellulose | 0.3 | 0.3 | 0.3 | 0.3 | 0.3 |
| Ethylenediamine tetraacetate | 0.1 | 0.1 | 0.1 | 0.1 | 0.1 |
| Fluorescer | 0.3 | 0.3 | 0.3 | 0.3 | 0.3 |
| Sodium sulphate | 17.0 | 17.0 | 17.0 | 17.0 | 17.0 |
| Sodium carbonate | 15.0 | – | 30.0 | 25.0 | 30.0 |
| Manganous sulphate/chloride | 1.5 | 2.0 | 0.5 | 1.0 | 0.2 |
| Sodium perborate tetra hydrate | – | – | 23.0 | 23.0 | – |
| Sodium percarbonate | 23.0 | 23.0 | – | – | 23.0 |
| Proteolytic enzyme | – | – | + | + | – |
| Water | ←←up to 100%→→ | | | | |

EXAMPLE XI

The following composition was prepared:

| Composition | (% by weight) |
|---|---|
| Sodium $C_{12}$ alkylbenzene sulphonate | 14.0 |
| Sodium carbonate | 30.0 |
| Sodium silicate | 8.0 |
| Sodium sulphate | 13.0 |
| Sodium perborate | 25.0 |
| Fluorescer | 0.3 |
| Sodium carboxymethylcellulose | 1.0 |
| Manganous sulphate | ± |
| Water up to 100%. | |

This composition was tested at a dosage of 5 g/l in a one hour isothermal wash at 25° C. in 24° H. water, using varying amounts of $Mn^{2+}$ (manganous sulphate in the product).

The bleaching results obtained on tea-stained cloths, measured as ΔR, were as follows:

TABLE 5

| [$Mn^{2+}$] ppM in solution | [$Mn^{2+}$] % in product | ΔR |
|---|---|---|
| 0 | 0 | 8.0 |
| 0.5 | 0.01 | 14.0 |
| 1.0 | 0.02 | 17.0 |
| 2.0 | 0.04 | 17.7 |
| 5.0 | 0.10 | 16.0 |
| 7.0 | 0.14 | 14.0 |
| 10.0 | 0.20 | 11.0 |

EXAMPLE XII

The following compositions were prepared:

| Composition (% by weight) | XII | C |
|---|---|---|
| Sodium $C_{12}$ alkylbenzene sulphonate | 14.0 | 6.0 |
| Nonionic ethoxylate compound | – | 4.0 |
| Sodium triphosphate | – | 36.0 |
| Sodium carbonate | 30.0 | – |
| Alkaline sodium silicate | 8.0 | 8.0 |
| Ethylene diamine tetraacetate | 0.1 | 0.1 |
| Sodium carboxymethylcellulose | 1.0 | 1.0 |
| Sodium sulphate | 13.0 | 11.0 |
| Sodium perborate | 25.0 | 25.0 |
| Fluorescer | 0.5 | 0.5 |
| Manganous chloride | + | + |
| Water up to 100%. | | |

Composition XII was tested on tea-stained test cloths against Composition C in a 60 minute heat-up-to-boil wash, using 24° H water. The compositions XII and C contained 0.04% by weight of $Mn^{2+}$ as manganous chloride and were used at a dosage of 5 g/l to give $[Mn^{2+}]$ in solution of 2 ppm.

The following results were obtained:

TABLE 6

| Time (min) | Temp. (°C.) | ΔR (XII) | ΔR (C) |
|---|---|---|---|
| 11.6 | 30 | 1 | 0.5 |
| 17.6 | 40 | 5 | 1.0 |
| 24.9 | 50 | 12 | 2.0 |
| 31.1 | 60 | 16 | 4.2 |
| 40.1 | 70 | 20 | 10.8 |
| 46.0 | 80 | 22 | 16.0 |
| 55.0 | 90 | 23 | 22.0 |

I claim:

1. A bleach composition having an improved bleach performance at substantially all temperatures, comprising a peroxide compound selected from the group of hydrogen peroxide and inorganic persalts which liberate hydrogen peroxide in aqueous solution, a manganese compound which delivers manganese (II) ions in aqueous solution in an amount of 0.005 to 5% by weight of manganese (II), and a carbonate compound which delivers carbonate ions in aqueous solution in an amount of 1 to 50% by weight of carbonate ions.

2. A bleach composition according to claim 1, which comprises 0.025–2.5% by weight of manganese (II).

3. A bleach composition according to claim 1, which comprises 5–35% by weight of carbonate ions.

4. A bleach composition according to claim 1, which comprises a manganese (II) salt selected from manganous sulphate, manganous chloride and mixtures thereof.

5. A bleach composition according to claim 1, which comprises a carbonate compound selected from alkalimetal carbonates and alkalimetal percarbonates and mixtures thereof.

6. A bleach composition according to claim 1, which further comprises from 2–50% by weight of a surface-active agent.

7. A bleach composition according to claim 1, which further comprises an alkaline detergency builder in an amount of up to 80% by weight.

8. A bleach composition according to claim 7, wherein the alkaline detergency builder is sodium triphosphate.

9. A bleach composition according to claim 7, which is free from sodium triphosphate.

10. A bleach composition according to claim 9, comprising 0.005–1% by weight of manganese (II).

* * * * *